US006536300B1

(12) United States Patent
Gonring

(10) Patent No.: US 6,536,300 B1
(45) Date of Patent: Mar. 25, 2003

(54) ADJUSTABLE FOOT PEDAL APPARATUS

(75) Inventor: Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/908,357

(22) Filed: Jul. 18, 2001

(51) Int. Cl.[7] ..... G05G 1/14
(52) U.S. Cl. ..... 74/513; 74/560
(58) Field of Search ..... 74/512, 513, 560, 74/561, 562, 562.5, 395; 84/422.1, 422.2, 422.3; 180/334; 403/93, 96, 97, 98, 103, 359.1

(56) References Cited

U.S. PATENT DOCUMENTS

| | | | | | |
|---|---|---|---|---|---|
| 4,182,198 | A | * | 1/1980 | Dartnell | 74/513 |
| 4,712,443 | A | | 12/1987 | Deane | 74/470 |
| 4,875,385 | A | | 10/1989 | Sitrin | 74/512 |
| 4,965,417 | A | * | 10/1990 | Massie | 200/86.5 |
| 5,039,118 | A | * | 8/1991 | Huang | 280/47.371 |
| 5,078,024 | A | | 1/1992 | Cicotte et al. | 74/512 |
| 5,133,225 | A | * | 7/1992 | Lundberg et al. | 200/61.89 |
| 5,154,435 | A | * | 10/1992 | Chiu | 280/47.315 |
| 5,214,979 | A | * | 6/1993 | Crack | 74/501.5 R |
| 5,460,061 | A | | 10/1995 | Redding et al. | 74/512 |
| 5,507,201 | A | * | 4/1996 | Fairbairn et al. | 74/513 |
| 5,516,142 | A | * | 5/1996 | Hartan | 280/642 |
| 5,520,474 | A | * | 5/1996 | Liu | 403/103 |
| 5,597,209 | A | * | 1/1997 | Bart et al. | 297/411.32 |
| 5,632,183 | A | | 5/1997 | Rixon et al. | 74/512 |
| 5,666,860 | A | * | 9/1997 | Baumann et al. | 74/513 |
| 5,697,260 | A | | 12/1997 | Rixon et al. | 74/514 |
| 5,700,102 | A | * | 12/1997 | Feleppa | 403/170 |
| 5,867,911 | A | * | 2/1999 | Yates et al. | 16/326 |
| 5,913,946 | A | | 6/1999 | Ewing | 74/513 |
| 5,934,152 | A | * | 8/1999 | Aschoff et al. | 123/399 |
| 5,941,141 | A | * | 8/1999 | Whitley | 403/93 |
| 6,023,995 | A | * | 2/2000 | Riggle | 74/514 |
| 6,170,355 | B1 | | 1/2001 | Fay, III | 74/512 |
| 6,178,847 | B1 | | 1/2001 | Willemsen et al. | 74/512 |
| 6,237,565 | B1 | | 5/2001 | Engelgau | 123/399 |

* cited by examiner

*Primary Examiner*—David A. Bucci
*Assistant Examiner*—Julie K. Smith
(74) *Attorney, Agent, or Firm*—William D. Lanyi

(57) ABSTRACT

A foot pedal apparatus is provided with a stationary support structure and a shaft supported by the support structure. A bracket and an actuator are attachable to each other for synchronous rotation about an axis of the shaft. A rotational connector is moveable to selectively connect and disconnect the bracket and actuator to allow coordinated rotation about the axis or independent rotation about the axis, respectively. The structure of the foot pedal apparatus allows the "at rest" position of the foot pedal to be easily adjusted.

19 Claims, 4 Drawing Sheets

ADJUSTABLE FOOT PEDAL APPARATUS

BACKGROUND OF THE INVENTION

1. Field Of The Invention

The present invention is generally related to a foot pedal apparatus for use in controlling an operating parameter, such as rate of acceleration of a vehicle and, more particularly, to an adjustable foot pedal apparatus that is easily moved to change its natural resting position without the need for tools.

2. Description of the Prior Art

Many different types of adjustable pedals are known to those skilled in the art.

U.S. Pat. No. 5,078,024, which issued to Cicotte et al on Jan. 7, 1992, describes a control pedal apparatus for a motor vehicle. The apparatus is intended for use in adjusting a control pedal of a motor vehicle such as a brake pedal, an accelerator pedal, or a clutch pedal. The mechanism includes a pedal arm, an adjustor member, and a bracket secured to the fire wall of the vehicle. The mechanism allows the position of the pedal pad to be adjusted slidably on the adjustor member without disturbing the position of the particular control element actuated by the pedal assembly, and selectively moves the pivot axis of the pedal assembly to maintain a fixed mechanical advantage of the pedal assembly irrespective of the position of adjustment of the pedal arm on the adjustor member. Coacting slots allow the pivot axis to be selectively moved during adjustment of the assembly but coact in response to depression of the pedal to fix the position of the pivot axis in any adjusted position of the pedal arm so that the pedal assembly pivots positively about the instantaneous assembly axis in any adjusted position of the pedal arm. The adjustment of the pedal arm is accomplished by the rotation of a screw engaging a nut on the pedal arm with the screw being driven by an electric motor.

U.S. Pat. No. 6,237,565, which issued to Engelgau on May 29, 2001, describes an adjustable pedal assembly with electronic throttle control. The vehicle control pedal apparatus includes a support adapted to be mounted to an vehicle structure and an adjustable pedal assembly having a pedal arm that is moveable in fore and aft directions with respect to the support. A pivot pivotally supports the adjustable pedal assembly with respect to the support and defines a pivot axis. The control pedal apparatus further includes an electronic throttle control attached to the support for controlling an engine throttle. The apparatus is characterized by the electronic throttle control being responsive to the pivot for providing a signal that corresponds to pedal arm position as the pedal arm pivots about the pivot axis between rest and applied positions. Thus, the control pedal apparatus can adjust pedal arm position in fore and aft positions without having to as move the electronic throttle control unit along with the pedal arm. Additionally, the electronic throttle control is responsive to the pivot about which the adjustable pedal assembly rotates.

U.S. Pat. No. 4,875,385, which issued to Sitrin on Oct. 24, 1989, describes a control pedal apparatus for a motor vehicle. The apparatus for adjusting a control pedal of a motor vehicle such as a brake pedal or an accelerator pedal is described. The mechanism includes a pedal arm, an adjustor member, and a bracket secured to the fire wall of the vehicle. The mechanism allows the position of the pedal pad to be adjusted slidably on the adjustor member without disturbing the position of the particular control element actuated by the pedal assembly, and selectively moves the pivot axis of the pedal assembly to maintain a fixed mechanical advantage of the pedal assembly irrespective of the position of adjustment of the pedal arm on the adjustor member.

U.S. Pat. No. 5,460,061, which issued to Redding et al on Oct. 24, 1995, describes an adjustable control pedal apparatus. The apparatus for a motor vehicle includes an accelerator control panel assembly and a brake control pedal assembly. A motor is positioned between the control pedal assemblies and includes a motor drive shaft driving first and second cables secured to the opposite ends of the drive shaft. The cables extend respectively to the brake and accelerator pedal assemblies so as to provide rotary cable movement at each pedal assembly.

U.S. Pat. No. 4,712,443, which issued to Deane on Dec. 15, 1987, describes a mechanical over-ride linkage. The override mechanism is disclosed for connection between the accelerator pedal of a vehicle and the fuel supply for normally enabling the driver to adjust the fuel supply but which can be overridden by speed limiting means. The throttle pedal is connected to move a lever to increase the fuel supply. This lever is pivoted to a clamp member via a shaft. The clamp member is clamped to a shaft whose angular movement adjusts the fuel supply. A spring resists pivoting movement of the lever with respect to the clamp member and therefore movement of the pedal is normally transmitted directly to the clamp to adjust the fuel supply. However, when the speed reaches an upper limit, an actuator pulls on a cable which is clamped to a part rigid with the clamp. Therefore, the part moves relative to the cable carrier and the lever against the force of the spring. The clamp therefore closes the fuel supply.

U.S. Pat. No. 5,697,260, which issued to Rixon et al on Dec. 16, 1997, describes an electronic adjustable pedal assembly. The assembly for a motor vehicle includes a carrier, a guide rod adapted to be secured to the dash panel of the vehicle and mounting the carrier for fore and aft movement along the guide rod, a power drive operative to move the carrier along the guide rod, a pedal arm pivotally mounted on the carrier, a potentiometer mounted on the carrier and operative to generate an output electrical signal proportioned to the extend of pivotal movement of the pedal arm, and a resistance assembly to provide feedback to the operator. The resistance assembly includes an annular friction surface defined on the carrier, a sleeve positioned over the friction surface, and a coil spring encircling the sleeve and arranged to be tightened in response to pivot movement of the pedal arm to squeeze the sleeve against the friction surface and generate a friction resistance force. The friction resistance force adds to the torsional resistance force of the spring during application of the pedal and subtracts from the torsional resistance force of the spring upon release of the pedal, whereby to create a hysteresis effect.

U.S. Pat. No. 6,170,355, which issued to Fay on Jan. 9, 2001, describes an ergonomic range accommodating adjustable foot pedal. The invention provides an easily adjustable foot-operated pedal assembly, such as a brake pedal for use in heavy equipment, that can be placed in multiple positions to accommodate people of differing heights and body shapes. The pedal is mounted in an assembly including a dual linkage operating apparatus having one element of that linkage that freely rotates about a shaft. A second link of the pedal linkage is connected to a fixed link through an adjustment mechanism. The fixed link is fixedly mounted to the same shaft as the pedal link. The adjustment mechanism incorporates a latch that has multiple settings yielding three or more pedal positions. The pedal is urged upwardly to effect adjustment to raise the pedal. A latch bar of the pedal assembly is urged up to allow lowering of the pedal.

U.S. Pat. No. 5,632,183, which issued to Rixon et al on May 27, 1997, describes an adjustable pedal assembly. The pedal apparatus is intended for use with a motor vehicle. The pedal assembly is slidably mounted at its upper end on a single hollow guide rod extending rearwardly from a transmission housing which in turn is pivotally mounted to a bracket secured to the fire wall of the vehicle. A nut is positioned slidably within the hollow guide rod and a screw shaft extends rearwardly from the transmission housing for threaded engagement with the nut. A key extends from the nut to the pedal assembly so that linear movement of the nut within the hollow rod is generated by rotation of the screw shaft results in forward and rearward movement of the pedal assembly along the guide rod. The screw shaft is driven by a transmission positioned in the transmission housing and the transmission is in turn driven by a cable driven by an electric motor.

U.S. Pat. No. 6,178,847, which issued to Willemsen et al on Jan. 30, 2001, describes an adjustable vehicle control pedal. The pedal apparatus is used in a motor vehicle. The brake and/or clutch pedal apparatus includes a driven pedal arm rotatably and operatively mounted to the vehicle mounted to the vehicle about a rotation axis substantially parallel to the pitch axis. An inner pedal arm is adjustably mounted to the driven pedal arm and a pedal is attached to the inner pedal arm. The brake and/or clutch pedal apparatus further comprises a mechanism disposed within the driven pedal arm for varying the proximity of the pedal to the operator. The accelerator pedal apparatus of the invention comprises an inner pedal arm rotatably and operatively mounted to the vehicle about a rotation axis substantially parallel to the pitch axis. A driven pedal arm is adjustably mounted to the inner pedal arm, and a pedal is attached to the driven pedal arm. The accelerator pedal apparatus also comprises a mechanism, substantially disposed within the inner pedal arm and the outer pedal arm, for varying the proximity of the pedal to the operator.

U.S. Pat. No. 5,913,946, which issued to Ewing on Jun. 22, 1999, describes an adjustable accelerator pedal apparatus. The apparatus allows the adjustment of a first end of a pedal lever to accommodate operators having varying anatomical characteristics. The apparatus includes an adjuster link having a first end pivotally connected to a second point on a rocker, a first end pivotally connected to a first ground point. An anchor link is pivotally connected to a second ground point at one end and a third point of the rocker at the opposite end. A cable interconnects the pedal lever to the throttle linkage, thereby allowing actuation of the throttle upon displacement of the pedal. The interconnection of the adjuster link and a second point on the rocker form a virtual ground point allowing the first end of the pedal lever to be adjusted between first and second pedal positions.

The patents described above are hereby expressly incorporated by reference in the description of the preferred embodiment.

It would be significantly beneficial if a foot pedal adjustment apparatus could be provided which does not require the operator to use tools in order to change the resting position of the foot pedal. This would allow the pedal position to be more easily adjusted to improve the comfort of the operator when operating the vehicle.

SUMMARY OF THE INVENTION

A foot pedal apparatus made in accordance with a preferred embodiment of the present invention comprises a stationary support structure which is attachable to a vehicle such as a land vehicle or marine vessel. The shaft is supported by the stationary support structure for rotation about an axis. A bracket is connected to the shaft and the bracket is axially moveable relative to the shaft in a direction parallel to the shaft. An actuator is attachable to the bracket for rotation with the bracket. The actuator can also be attached to the shaft for rotation with the shaft in certain embodiments of the present invention.

An angular position sensor has a first portion attached to the actuator and a second portion attached to the stationary support structure. The angular position sensor can be a potentiometer device with the first portion being the winding portion of the potentiometer and the second portion being the wiper. It should be understood that the angular position sensor can also be a Hall effect device or any other type of sensor which provides a signal that is representative of the angular position of the bracket with respect to the stationary support structure. A rotational connector is provided which is connectable between the bracket and the actuator. The rotational connector is moveable to selectively connect or disconnect the bracket and the actuator together. When connected together, the bracket and the actuator move in a coordinated manner about the axis. When disconnected, the bracket and the actuator are allowed to rotate relative to each other.

A plate can be attached to the bracket, wherein the plate is shaped to be rotationally moveable in response to foot movements of an operator of the vehicle. Axial movement of the bracket in a direction parallel to the axis and relative to the actuator disconnects the bracket from the actuator to allow relative rotation to occur between the bracket and the actuator about the axis. The rotational connector, in a particularly preferred embodiment of the present invention, comprises first and second gear portions. The first gear portion is attached to the actuator and the second gear portion is attached to the bracket. The second gear portion is moveable out of meshing relation with the first gear portion when the bracket is moved axially away from the actuator in a direction parallel to the axis. The first gear portion can be a toothed cavity and the second gear portion can be a toothed protrusion. The toothed cavity is shaped to receive the toothed protrusion in meshing relation.

A preferred embodiment of the present invention further comprises an axially resilient member, such as a spring, associated with the bracket to resist movement of the bracket away from the actuator in a direction parallel to the shaft. The axially resilient member constantly urges the bracket toward a position where it is rotationally attached to the actuator.

A rotationally resilient member is associated with the shaft for urging the shaft to a preselected rotational position. This preselected rotational position is typically a position assumed by the bracket when the pedal apparatus is at rest. The rotationally resilient member can be a coil spring. The bracket is rotationally attached in spline association with the shaft in a preferred embodiment of the present invention in order to maintain rotational synchrony between the bracket and the shaft while allowing relative axial movement of these two components.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
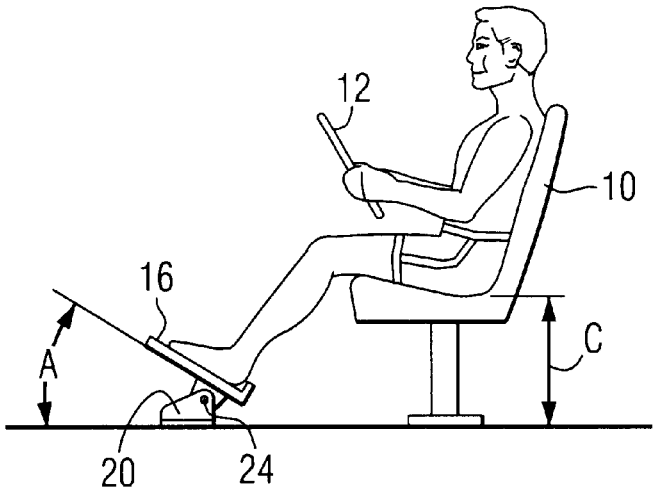
FIGS. 1 and 2 show an operator of a vehicle in relation to a foot pedal apparatus.

Throughout the description of preferred embodiment of the present invention, like components will be identified by like reference numerals.

Figure 2:
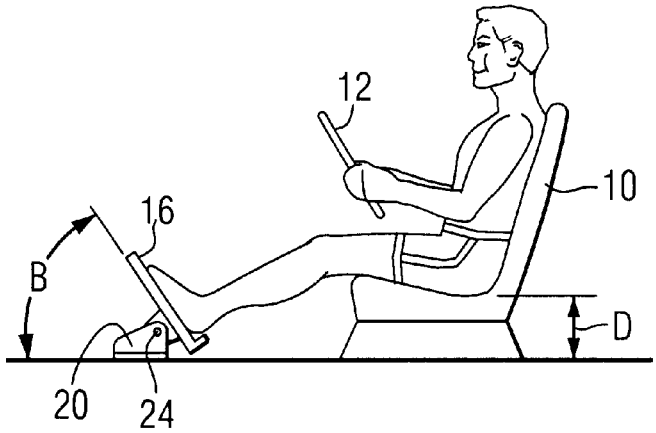

FIGS. 1 and 2 show an operator of a vehicle sitting on a seat 10, holding a steering wheel 12 and positioned to operate a plate 16 of a foot pedal apparatus. The foot pedal apparatus comprises a stationary support structure 20 which is attached to the vehicle. The plate 16 is rotatable about a pivot 24 to allow the operator to control a parameter of the vehicle, such as a rate of acceleration. The dimensions represented by height C and D in FIGS. 1 and 2 show different seating positions of the operator relative to the foot pedal apparatus. Dimension C is greater in magnitude than dimension D. As a result, angle A typically must be less than angle B to accommodate for the greater magnitude of height C relative to height D. This accommodation is for operator comfort. The purpose of the present invention is to provide a foot pedal apparatus that is easily adjustable from one "at rest" magnitude, such as angle B, to a different "at rest" magnitude, such as angle A, to improve the comfort of the operator. Naturally, the operator is able to change the angle of the plate 16 in order to affect the magnitude of the controlled parameter, such as acceleration. The angles identified in FIGS. 1 and 2 represent the "at rest" angle from which the operator can increase the angle to affect the controlled parameter. For example, the "at rest" position of an acceleration pedal would be an idle engine speed position that could be increased by decreasing the angle between the plate 16 and the floor of the vehicle.

With continued reference to FIGS. 1 and 2, it should be understood that although the stationary support structure 20 is shown attached to a floor of a vehicle, the stationary support structure could alternatively be attached to a fire wall of a vehicle or any other stationary structure.

Figure 3:
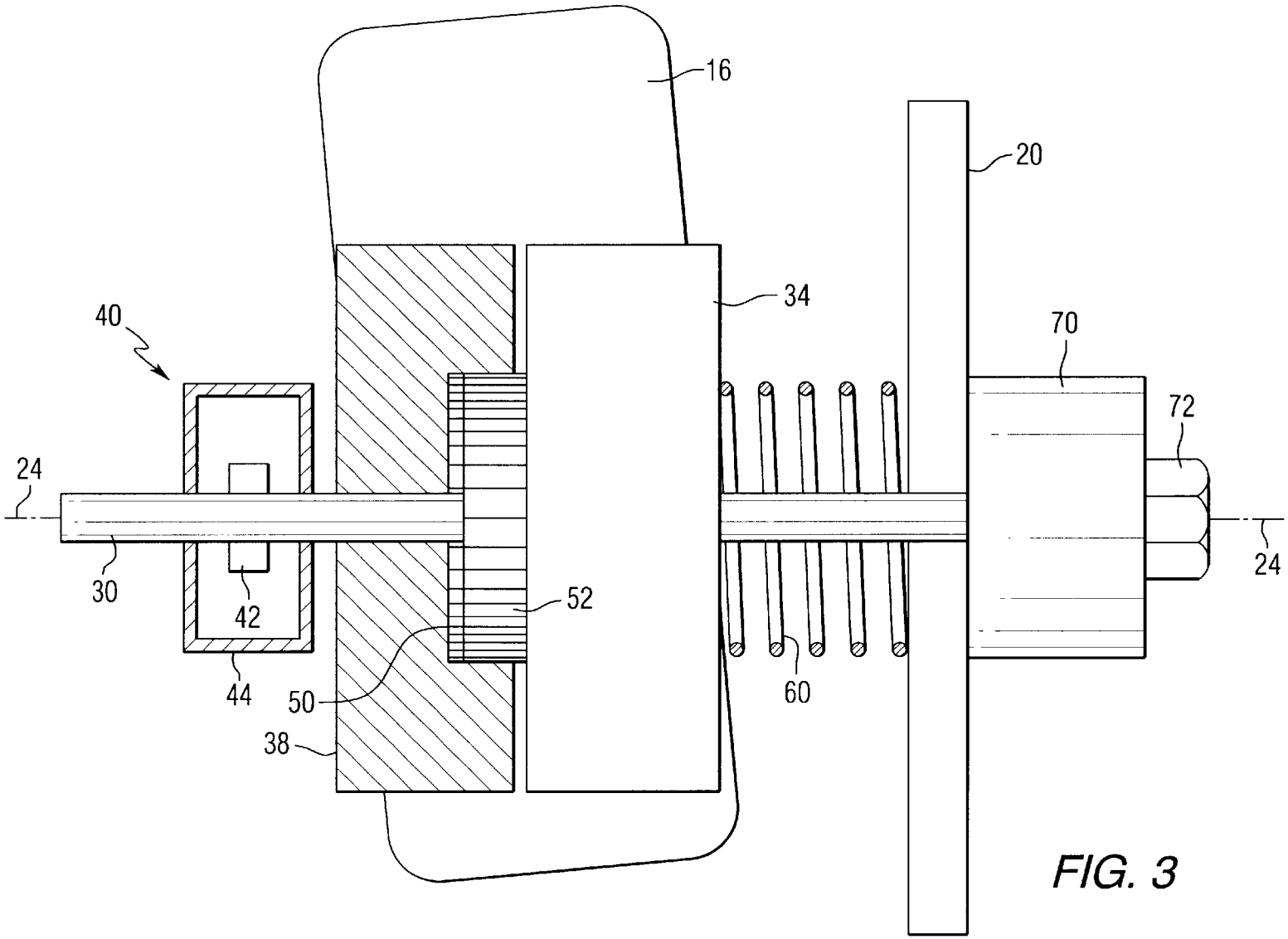
FIGS. 3 and 4 show engaged and disengaged positions of a bracket of the foot pedal apparatus in relation to an actuator.
Figure 4:
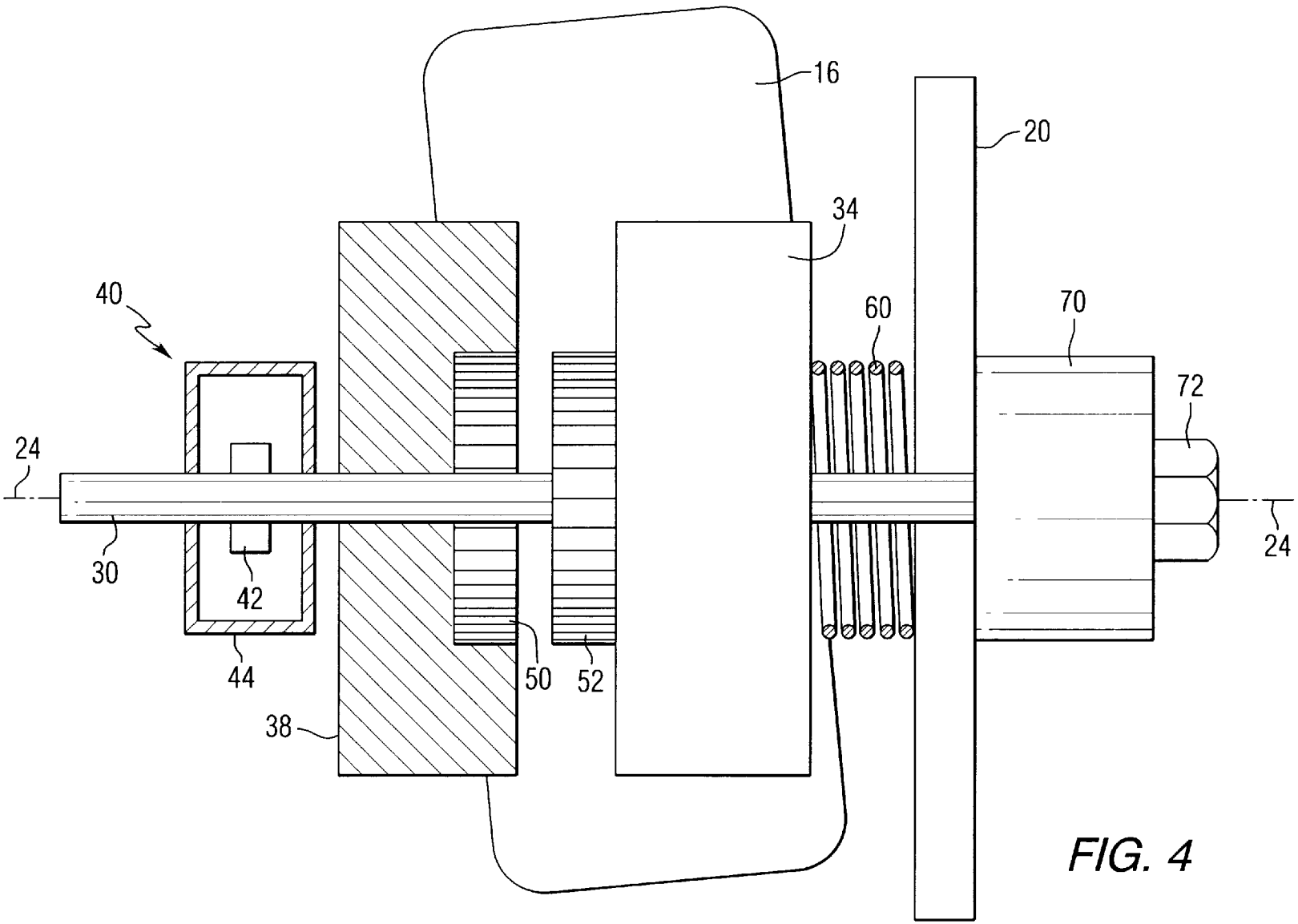

FIGS. 3 and 4 are highly schematic representations that are intended to show the basic operation of the present invention and also the relative positions and movements of its components. A more detailed illustration will be provided in conjunction with the subsequent description relating to FIG. 6. The stationary support structure 20 is represented simply as a wall portion in FIG. 3. The stationary support structure 20 is attachable to the vehicle being controlled by the pedal apparatus. A shaft 30 is supported by the stationary support structure 20 for rotation about axis 24. A bracket 34 is connected to the shaft 30 and is axially moveable relative to the shaft 30 in a direction parallel to the axis 24. In FIG. 3, this means that the bracket 34 is moveable relative to the stationary support structure 20 in a direction to the right or left. An actuator 38 is attached to the shaft 30 for rotation with the shaft. It is also attachable to the bracket 34 as will be described in greater detail below.

An angular position sensor 40 has a first portion 42 attached to the actuator 38 and a second portion 44 attached to the stationary support structure 20. When the first and second portions, 42 and 44, rotate relative to each other, a signal is provided to an engine control unit of the vehicle and that signal represents a to relative rotational position between the bracket 34 and the stationary support structure 20. Although the first portion 42 is shown as being the rotatable portion and the second portion 44 is shown as being the stationary portion attached to the stationary support bracket 20, these roles can be reversed in alternative embodiments of the present invention.

With continued reference to FIG. 3, a rotational connector comprises a first gear portion 50 attached to the actuator 38 and a second gear portion 52 attached to the bracket 34. The second gear portion 52 is moveable out of meshing relation with the first gear portion 50 when the bracket 34 is moved axially away from the actuator 38 in a direction parallel to the axis 24. In other words, when the bracket 34 moves toward the right in FIG. 3, the second gear portion 52 is disengaged from the first gear portion 50. The first gear portion 50 can be a toothed cavity formed in the actuator 38 and the second gear portion 52 can be a toothed protrusion attached to and extending from the bracket 34. When in the position shown in FIG. 3, the second gear portion 52 is moved into meshing relation with the first gear portion 50.

An axially resilient member 60, or spring, is associated with the bracket 34 to resist movement of the bracket 34 away from the actuator 38 in a direction parallel to the axis 24. In a preferred embodiment, the axially resilient member 60 is a spring disposed between the stationary support structure 20 and the bracket 34. A rotationally resilient member, not visible in FIG. 3, is disposed within the housing 70. The rotationally resilient member is associated with the shaft 30 to urge the shaft to a preselected rotational position relative to the stationary support structure 20. This preselected rotational position represents the "at rest" position discussed above. In a preferred embodiment of the present invention, the rotationally resilient member is a coil spring as will be described in greater detail below.

FIG. 4 is similar to FIG. 3, but with the bracket 34 moved toward the right in a direction parallel to axis 24 and away from the actuator 38. In this position, the second gear portion 52 is disengaged from the first gear portion 50 and the bracket 34 is allowed to rotate about shaft 30 so that the operator can select a new "at rest" position for the plate 16 which is attached to the bracket 34. This is done by compressing the axially resilient member 60 between the bracket 34 and the stationary support structure 20. After a new "at rest" position is selected, the bracket 34 is moved back toward the actuator 38 to allow the second gear portion 52 to move into the toothed cavity of the first gear portion 50 and engage the actuator 38 to the bracket 34 for synchronous rotation with each other.

With reference to FIGS. 3 and 4, the housing 70 is provided with a hex shaped extension 72. This allows the operator to change the relative position between the housing 70 and the stationary support structure 20. Since the housing 70 contains the rotationally resilient member or coil spring, changing the relative position of the housing 70 to the stationary support structure 20 allows the operator to adjust the effect of spring 80. It should be understood that resetting the "at rest" position of the bracket 34 does not require any change in the position of housing 70 or its hex shaped extension 72.

Figure 5:
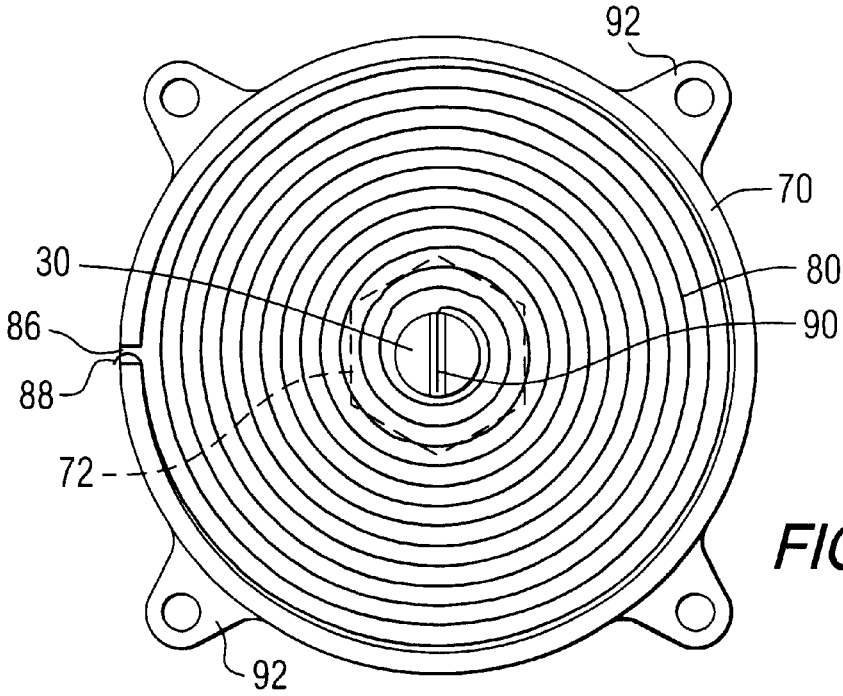
FIG. 5 shows a coil spring used as a rotationally resilient member in a preferred embodiment of the present invention.

FIG. 5 shows the housing 70 of the rotationally resilient member 80, with the hex shaped extension 72 being represented by dashed lines. One end of the spring 80 is disposed in an opening 86 to fix that end in position relation to the housing 70. The other end 90 of the spring 80 is disposed in a diametrical slot formed in the shaft 30. The plurality of tabs 92 which are formed as part of the housing 70 allow the housing 70 to be attached to the stationary support structure 20, as discussed above in conjunction with FIGS. 3 and 4. This, in turn, attaches end 88 of the spring 80 in a fixed relationship with the stationary support structure 20. By disconnecting the threaded connectors used in conjunction with tabs 92 from engagement with the stationary support structure 20, the housing 70 can be rotated about axis 24 by using the hex shaped protrusion 72. This changes the relative position of end 88 of the spring 80 relative to the stationary support structure 20 and allows the force of spring 80 to be changed. It should be clearly understood that this type of adjustment, using the housing 70 to move end 88 of the spring 80 relative to the stationary support structure 20, is not expected to be performed except during initial installation of the pedal apparatus. All future adjustments would be expected to relate to the bracket 34 and plate 16 relative to the stationary support structure 20 to change the relative rotational position of the bracket 34 relative to the shaft 30.

Figure 6:
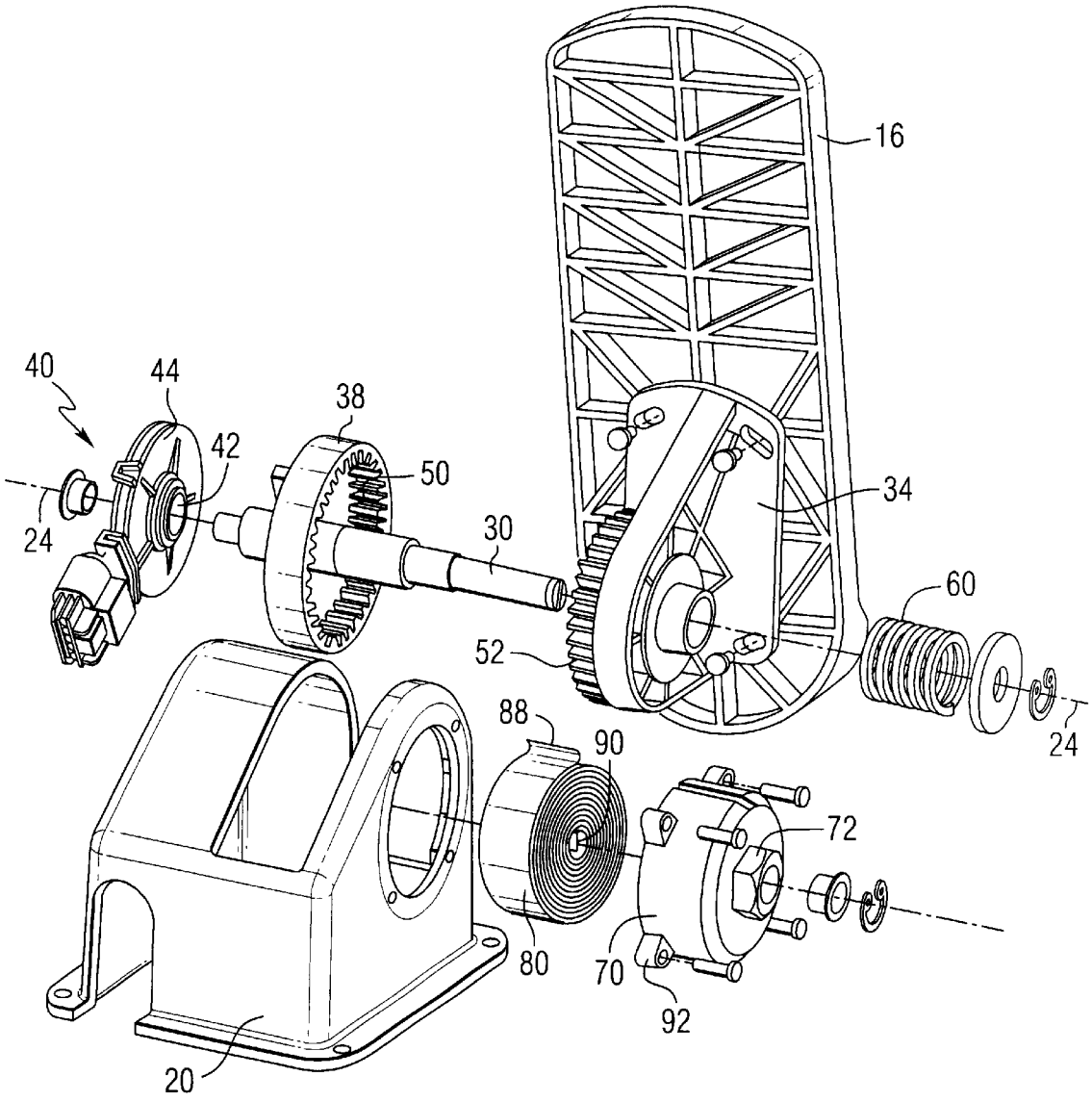
FIG. 6 is an exploded isometric view of the present invention.

FIG. 6 is an exploded isometric view of the present invention. The stationary support structure 20 provides a housing that supports the other components shown in FIG. 6. The shaft 30 is directly supported by the stationary support structure 20 for rotation about axis 24. Bracket 34 is connected to the shaft 30 and is axially moveable relative to the shaft 30 in a direction parallel to axis 24. Actuator 38 is attached to and supported by shaft 30 for rotation with shaft 30. As can be seen, bracket 34 is moveable axially into engagement with actuator 38 or out of engagement with actuator 38, which is accomplished by meshing the first and second gear portions, 50 and 52, into and out of engagement. The spring 80 is contained within housing 70 which, in turn, is attached to the stationary support structure 20 by screws extending through the tabs 92. The axially resilient member 60 maintains the first and second gear portions, 50 and 52, in engagement with each other. By compressing the axially resilient member 60, the first and second gear portions can be separated to allow relative rotation about axis 24 between the bracket 34 and the actuator 38.

Although the present invention has been described in particular detail and illustrated to show a preferred embodiment, it should be understood that alternative embodiments are also within its scope.

I claim:

1. A foot pedal apparatus, comprising:

a stationary support structure which is attachable to a vehicle;

a shaft supported by said stationary support structure concentric with an axis;

a bracket, said shaft extending through an opening formed in said bracket, said bracket being rotatable about said axis and axially movable in a direction parallel to said axis;

a plate attached to said bracket for rotation with said bracket about said axis, said plate being shaped to be movable in response to foot movements of an operator of said vehicle an actuator attachable to said bracket for rotation with said bracket, said bracket being axially movable relative to said actuator in a direction parallel to said axis;

an angular position sensor attached to said actuator and to said stationary support structure; and a rotational connector which is movable to selectively connect said bracket and said actuator together for coordinated rotation about said axis or disconnect said bracket from said actuator to allow relative rotation between said bracket and said actuator about said axis.

2. The apparatus of claim 1, wherein:

axial movement of said bracket in said direction parallel to said axis and relative to said actuator causes said rotational connector to disconnect said bracket from said actuator to allow relative rotation between said bracket and said actuator about said axis with said shaft extending through said opening formed in said bracket.

3. The apparatus of claim 1, wherein:

said rotational connector comprises first and second gear portions, said first gear portion being attached to said actuator and said second gear portion being attached to said bracket.

4. The apparatus of claim 3, wherein:

said second gear portion is movable out of meshing relation with said first gear portion when said bracket is moved axially away from said actuator in a direction parallel to said axis.

5. The apparatus of claim 3, wherein:

said first gear portion is a toothed cavity and said second gear portion is a toothed protrusion, said toothed cavity being shaped to receive said toothed protrusion in meshing relation.

6. The apparatus of claim 1, further comprising:

an axially resilient member associated with said bracket to resist movement of said bracket away from said actuator in a direction parallel to said shaft.

7. The apparatus of claim 1, further comprising:

a rotationally resilient member associated with said shaft for urging said shaft to a preselected position.

8. The apparatus of claim 7, wherein:

said rotationally resilient member is a coil spring.

9. The apparatus of claim 1, wherein:

said bracket is rotationally attachable with said shaft.

10. The apparatus of claim 1, wherein:

said angular position sensor is a potentiometer.

11. A foot pedal apparatus, comprising:

a stationary support structure which is attachable to a vehicle;

a shaft supported by said stationary support structure concentric with an axis;

a bracket, said shaft extending through an opening formed in said bracket, said bracket being axially movable relative to said stationary support structure in a direction parallel to said axis and rotatable about said axis;

an actuator attached to said shaft for rotation with said shaft, said bracket being axially movable relative to said actuator in a direction parallel to said axis;

an angular position sensor having a first portion attached to said actuator and a second portion attached to said stationary support structure; and a rotational connector which is movable to selectively connect said bracket and said actuator together for coordinated rotation about said axis or disconnect said bracket from said actuator to allow relative rotation between said bracket and said actuator about said axis, wherein axial movement of said bracket in a direction parallel to said shaft and relative to said actuator causes said rotational connector to disconnect said bracket from said actuator to allow relative rotation between said bracket and said actuator about said axis.

12. The apparatus of claim 11, further comprising:

a plate attached to said bracket, said plate being shaped to be movable in response to foot movements of an operator of said vehicle.

13. The apparatus of claim 12, wherein:

said rotational connector comprises first and second gear portions, said first gear portion being attached to said actuator and said second gear portion being attached to said bracket, said second gear portion being movable out of meshing relation with said first gear portion when said bracket is moved axially away from said actuator in a direction parallel to said axis, said first gear portion being a toothed cavity and said second gear portion is a toothed protrusion, said toothed cavity being shaped to receive said toothed protrusion in meshing relation.

14. The apparatus of claim 13, further comprising:

an axially resilient member associated with said bracket to resist movement of said bracket away from said actuator in a direction parallel to said shaft.

15. The apparatus of claim 14, further comprising:

a rotationally resilient member associated with said shaft for urging said shaft to a preselected position.

16. The apparatus of claim 15, wherein:

said rotationally resilient member is a coil spring, said bracket is rotationally attachable with said shaft and said angular position sensor is a potentiometer.

17. A foot pedal apparatus, comprising:

a stationary support structure which is attachable to a vehicle;

a shaft supported by said stationary support structure concentric with an axis;

a bracket, said shaft extending through an opening formed in said bracket, said bracket being axially movable relative to said stationary support structure in a direction parallel to said axis and rotatable about said axis;

an actuator attached to said shaft for rotation with said shaft, said bracket being axially movable relative to said actuator in a direction parallel to said axis;

an angular position sensor having a first portion attached to said actuator and a second portion attached to said stationary support structure;

a rotational connector which is movable to selectively connect said bracket and said actuator together for coordinated rotation about said axis or disconnect said bracket from said actuator to allow relative rotation between said bracket and said actuator about said axis, wherein axial movement of said bracket in a direction parallel to said shaft and relative to said actuator causes said rotational connector to disconnect said bracket from said actuator to allow relative rotation between said bracket and said actuator about said axis;

a plate attached to said bracket, said plate being shaped to be movable in response to foot movements of an operator of said vehicle;

an axially resilient member associated with said bracket to resist movement of said bracket away from said actuator in a direction parallel to said shaft; and a rotationally resilient member associated with said shaft for urging said shaft to a preselected position.

18. The apparatus of claim 17, wherein:

said rotational connector comprises first and second gear portions, said first gear portion being attached to said actuator and said second gear portion being attached to said bracket, said second gear portion being movable out of meshing relation with said first gear portion when said bracket is moved axially away from said actuator in a direction parallel to said axis, said first gear portion being a toothed cavity and said second gear portion is a toothed protrusion, said toothed cavity being shaped to receive said toothed protrusion in meshing relation.

19. The apparatus of claim 18, wherein:

said rotationally resilient member is a coil spring, said bracket is rotationally attachable with said shaft and said angular position sensor is a potentiometer.

* * * * *